US008347924B2

(12) United States Patent
Meyer

(10) Patent No.: US 8,347,924 B2
(45) Date of Patent: Jan. 8, 2013

(54) FUEL PUMP NOZZLE

(75) Inventor: Heinz-Ulrich Meyer, Hamburg (DE)

(73) Assignee: Elaflex Hiby Tanktechnick GmbH & Co., Hamburg (DE)

( * ) Notice: Subject to any disclaimer, the term of this patent is extended or adjusted under 35 U.S.C. 154(b) by 0 days.

(21) Appl. No.: 13/231,557

(22) Filed: Sep. 13, 2011

(65) Prior Publication Data

US 2012/0073700 A1 Mar. 29, 2012

(30) Foreign Application Priority Data

Sep. 13, 2010 (EP) ..... 10009496

(51) Int. Cl.
*B65B 1/30* (2006.01)

(52) U.S. Cl. ..... 141/206; 141/208; 141/218

(58) Field of Classification Search ..... 141/206, 141/208, 218; 251/65, 155
See application file for complete search history.

(56) References Cited

U.S. PATENT DOCUMENTS

| | | | | |
|---|---|---|---|---|
| 3,323,560 | A * | 6/1967 | Ehlers | 141/208 |
| 3,886,974 | A | 6/1975 | Bjorklund | |
| 3,900,056 | A * | 8/1975 | Giardini et al. | 141/93 |
| 4,071,059 | A * | 1/1978 | Hansel | 141/206 |
| 4,331,187 | A * | 5/1982 | Trygg | 141/218 |
| 4,735,243 | A * | 4/1988 | Ehlers | 141/218 |
| 4,796,678 | A * | 1/1989 | Motohashi et al. | 141/206 |
| 5,131,441 | A * | 7/1992 | Simpson et al. | 141/209 |
| 5,379,811 | A * | 1/1995 | Dotson et al. | 141/206 |
| 5,417,259 | A * | 5/1995 | Schneider | 141/59 |
| 5,435,356 | A * | 7/1995 | Rabinovich | 141/59 |
| 5,450,884 | A * | 9/1995 | Shih et al. | 141/206 |
| 5,505,234 | A * | 4/1996 | Simpson et al. | 141/206 |
| 5,813,432 | A * | 9/1998 | Elsdon et al. | 137/413 |
| 6,126,047 | A * | 10/2000 | Johnson et al. | 222/505 |
| 7,040,358 | B2 * | 5/2006 | Lacroix et al. | 141/206 |
| 7,588,060 | B2 * | 9/2009 | Ballard | 141/226 |

FOREIGN PATENT DOCUMENTS

DE 102008010988 B3 7/2009

OTHER PUBLICATIONS

English Translation of Abstract for DE102008010988, 2009.

* cited by examiner

*Primary Examiner* — Timothy L Maust
(74) *Attorney, Agent, or Firm* — Casimir Jones, S.C.

(57) ABSTRACT

The invention relates to a main valve for a fuel pump nozzle, the main valve comprising a shut-off body for closing a fuel line and a displacement space that is configured to avoid undesirable pressure surges during closing of the main valve. The invention further relates to a fuel pump nozzle comprising a main valve according to the invention.

19 Claims, 4 Drawing Sheets

FUEL PUMP NOZZLE

The invention relates to a main valve for a fuel pump nozzle, and to a fuel pump nozzle.

Fuel pump nozzles are in the prior art—for example from U.S. Pat. No. 4,331,187, with an inlet, a discharge pipe, a main valve for controlling the stream of liquid between the inlet and discharge pipe, a switching lever for actuating the main valve, a first automatic safety shut-off which moves the main valve into the closed position if the liquid level in a tank to be filled reaches a filling level sensor arranged in the region of the discharge pipe, a second automatic safety shut-off which moves the main valve into the closed position if the liquid pressure at the inlet drops below a minimum value, and a mechanism for prestressing the main valve into the closed position, said mechanism bringing about a variable opening cross section of the main valve depending on the liquid pressure at the inlet.

Fuel pump nozzles, also called fuel nozzles at gasoline filling stations, are generally designed in the form of "automatic fuel pump nozzles". They have an automatic shut-off which prevents a tank which is to be filled from overflowing. Said automatic safety shut-off generally acts on the main valve of the fuel pump nozzle. It is furthermore known to provide a second automatic safety shut-off which completely closes the main valve of the fuel pump nozzle again even if the pressure at the inlet of the fuel pump nozzle falls below a certain threshold value. This is intended to ensure that, following switching off of the fuel feed pump in the filling pump and a resultant drop in the pressure at the inlet of the fuel pump nozzle, automatic closing takes place.

According to existing regulations (EN 13012), the main valves of fuel pump nozzles have to reach certain pressure tightnesses in the closed state. The pressure tightness is generally dependent on the strength of a closing spring with which the main valve is closed. In particular in the case of an automatic safety shut-off, the closing spring ensures that a shut-off body of the main valve is moved into the closed position. If the main valve has a large nominal size (the free cross section for the conduction of liquid when the main valve is open), a high closing spring force is required in order to achieve the required tightness.

Due to the closing spring force required to achieve the required pressure tightness, pressure surges occur in the entire system, comprising the fuel pump nozzle and the filling pump, upon an automatic safety shut-off and the subsequent rapid closing of the main valve. The service life and/or safety of using individual components of the system are/is significantly reduced because of said pressure surges. Mechanical components of the fuel pump nozzle have to have sufficiently high resistance to fracture in order to be able to withstand the pressure surges of main valves—in particular of those within a large nominal diameter. In addition, when the main valve is closed by the closing spring, the pressure surge is transmitted via the fuel in the tank hose between the fuel pump nozzle and filling pump as far as the fuel feed pump in the filling pump where it causes mechanical loading which reduces the service life of the fuel feed pump. Designing the individual components of the fuel pump nozzle and of the filling pump in respect of pressure surges which occur is associated with a considerable additional cost.

Starting from the prior art mentioned at the beginning, the invention is based on the object of providing a main valve for a fuel pump nozzle, and a fuel pump nozzle, in which pressure surges upon an automatic safety shut-off of the main valve are reduced or avoided.

This object is achieved by a main valve for a fuel pump nozzle according to the main claim, and a fuel pump nozzle according to further independent claim 11.

The invention thus relates to a main valve for a fuel pump nozzle, with a shut-off body for closing a liquid line, and a displacement space which can be reduced in size by movement of the shut-off body from the open position into the closed position, the displacement space being fluidically connected upstream and downstream of the shut-off body to the liquid line via secondary lines, and the secondary line to the liquid line upstream of the shut-off body being closed in the closed position of the shut-off body.

The invention furthermore relates to a fuel pump nozzle, with an inlet, a discharge pipe, a main valve for controlling the stream of liquid between the inlet and discharge pipe, with a shut-off body and a displacement space which can be reduced in size by movement of the shut-off body from the open position into the closed position, the displacement space being fluidically connected to the inlet and the discharge pipe via secondary lines, and the secondary line to the inlet being closed in the closed position of the shut-off body.

Some of the terms used in the context of the invention will be explained first.

The requirements for the construction and operation of automatic fuel pump nozzles for use on filling pumps are regulated in EN 13012. Terms defined there are also used in the present application.

A fuel pump nozzle is a device for the manual control of a flow of liquid, for example of the flow of fuel, during a refueling operation. The inlet is that region of the fuel pump nozzle through which the liquid is supplied, for example, by the filling pump. The main valve is the device which controls the flow of liquid. The term main valve does not imply that there has to be a second valve, secondary valve or the like. The switching lever is the device by means of which the user controls the main valve. The discharge pipe is the device through which the flow of liquid is conducted, for example, into a tank which is to be filled.

According to the invention, when the main valve is closed, i.e. when the shut-off body moves into the closed position, a displacement space is reduced in size at the same time. Since the displacement space is fluidically connected to the fuel line secondary lines, said space is filled with the liquid, which also flows through the liquid line, when the main valve is open. Upon reduction of the size of the displacement space, said liquid is displaced through the secondary lines to the liquid line upstream and downstream of the shut-off body. The movement of the shut-off body into the closed position is braked by the flow resistance which occurs in the process. In order, furthermore, to avoid that, when the main valve is closed, can pass from the liquid line upstream of the shut-off body via the secondary lines and the displacement space into the liquid line downstream of the shut-off body, the secondary line between the displacement space and the liquid line upstream of the shut-off body is likewise closed when the main valve is closed.

By means of the displacement space according to the invention, which is reduced in size by movement of the shut-off body from the open position into the closed position, the closing movement, which is generally initiated by a closing spring upon an automatic safety shut-off, is damped. Pressure surges are thereby effectively avoided without disadvantages arising with respect to the pressure tightness of the main valve. Furthermore, there is also a reduction in the disadvantages associated with pressure surges, for example an increased risk of fracturing of components in the fuel pump nozzle and the service life of the entire system.

It is preferred if an intermediate position is provided between the open position and closed position of the shut-off body, and the secondary line to the liquid line upstream of the shut-off body is closed when the shut-off body is in a position between the intermediate position and closed position. If the shut-off body is moved from the open position into the closed position, first of all both secondary lines to the liquid line upstream and downstream of the shut-off body are opened. Liquid can therefore flow out of the displacement space through the two secondary lines during the closing operation. After the intermediate position is reached, the secondary line to the liquid line upstream of the shut-off body is closed. The liquid can then only flow out of the displacement space through the secondary line to the liquid line downstream of the shut-off body.

After reaching of the intermediate position and the associated closing of one of the two secondary lines, the flow resistance for the liquid flowing out of the displacement space increases, and therefore the damping effect described also increases. The damping effect is accordingly dependent on the position of the shut-off body between the open position and closed position, and in particular whether the shut-off body is between the open position and intermediate position or between the intermediate position and closed position. For that region between the open position and intermediate position in which only small pressure surges, if any at all, should generally be anticipated during the closing operation, the damping effect can be kept low by an appropriate dimensioning of the secondary line between the displacement space and liquid line upstream of the shut-off body. By means of the dimensioning of the secondary line between the displacement space and liquid line downstream of the shut-off body, a higher damping effect can be achieved for the region in which the shut-off body is between the intermediate position and closed position. By means of the increased damping effect, the closing movement of the shut-off body can be braked in such a manner that pressure surges are effectively prevented or at least significantly reduced.

By skilful selection of the intermediate position and the particular damping effect in the described regions, rapid closing of the main valve (because of the lower damping effect between the open position and intermediate position) can be achieved with pressure surges being avoided (because of the higher damping effect between the intermediate position and closed position). Investigations have shown that it may be preferable for the region between the open position and intermediate position to be twice as large, and preferably four times larger than the region between the intermediate position and closed position.

It is preferred if the shut-off body is designed as a valve cone. A corresponding shut-off body can close a valve seat in the known manner. Furthermore, it is preferred if the displacement space is a cavity which is formed by a housing and a piston guided therein, the piston preferably being connected to the shut-off body by a valve stem.

In particular if the housing with the piston guided therein is arranged in the liquid line, one of the two secondary lines can be formed by a gap between the piston and housing. The other secondary line can preferably be formed by a throttle duct in the valve stem and/or shut-off body. The throttle duct is preferably designed for a maximum flow of 0.1 to 0.2 l of fuel per minute.

It is preferred if the liquid pressure is present upstream of the shut-off body at that end of the piston which faces away from the displacement space. In the closed state of the main valve, in which the secondary line to the liquid line upstream of the shut-off body is also closed, a pressure difference thus arises via the piston. By means of this pressure difference, a force which acts in an opening manner on the shut-off body because of pressure present in the liquid line upstream of the shut-off body is reduced. Elements which are intended to secure the shut-off body in the closed position can then be dimensioned to be smaller.

A "full hose mode" may occur in a fuel pump nozzle. In the full hose mode, the connecting hose between the filling pump and fuel pump nozzle is full of liquid and the feed pump does not convey any fuel. In order to prevent the connecting hose running dry in such a situation, a full hose lock can be provided, the full hose lock acting upon the shut-off body with a force in the direction of the closed position. The full hose lock can be designed as a magnetic pull element with two magnetically attracting components which are displaceable counter to each other. By means of a magnetic pull element of this type, the shut-off body can be kept in the closed position. In order to open the main valve, the retaining force of the magnetic pull element has to be overcome so that the shut-off body can move into the open position. In the closed position, a magnetic pull element can ensure that the main valve is not unintentionally opened, in particular not in the full hose mode.

The magnetic pull element can be designed in such a manner that, in the open position of the main valve, said pull element exerts only a very small force, if any at all, on the shut-off body and/or the main valve in the closing direction. As an alternative or in addition to the magnetic pull element, a compression spring which permanently exerts force on the shut-off body in the direction of the closed position can also be provided. Said compression spring can be designed as a full hose spring which adequately provides force for the full hose mode. However, it may also be a supporting spring which sufficiently applies force to move the shut-off body into the region of effect of the magnetic pull element. The lock for the full hose mode is then essentially applied by the magnetic pull element.

The full hose lock can preferably be arranged in the displacement space. If the displacement space is formed, as described, by a housing with a piston guided therein, it is possible, for example, for one part of the magnetic pull element to be fastened to the piston and for the other part to be fastened to the housing. By means of the mechanical connection between the piston and shut-off body, the latter is locked in the full hose mode.

The invention furthermore relates to a fuel pump nozzle with a main valve according to the invention. Reference is made to the above explanations regarding the description of the main valve.

In the fuel pump nozzle, the main valve is arranged between the inlet and outlet pipe which together form the liquid line. The secondary line of the main valve, which line connects the displacement space to the liquid line upstream of the shut-off valve, ends in the inlet in the case of the fuel pump nozzle according to the invention. The other secondary line, which connects the displacement space to the liquid line downstream of the shut-off valve, ends in the outlet pipe.

The fuel pump nozzle can furthermore comprise a first automatic safety shut-off which moves the shut-off body of the main valve into the closed position when the liquid level in a tank which is to be filled reaches a filling level sensor arranged in the region of the discharge pipe. Furthermore, a second automatic safety shut-off can be provided, which moves the shut-off body of the main valve into the closed position if the liquid pressure at the inlet falls below a minimum value.

Furthermore, it is preferred if the individual components of the fuel pump nozzle and/or of the main valve are coordinated with one another in such a manner that, when the main valve is closed by an automatic safety shut-off, the closing time is less than 1 s, and more preferably 0.2 to 0.5 s. The closing time is dependent inter alia on the dimensioning of the secondary lines, the ratio of the region between the open position and intermediate position to the region between the intermediate position and closed position, the spring force of the closing spring for moving the shut-off body into the closed position, and the shaping of the piston and housing, in which the piston is guided.

The invention will now be described by way of example using a preferred embodiment with reference to the attached drawings, in which.

Figure 1:
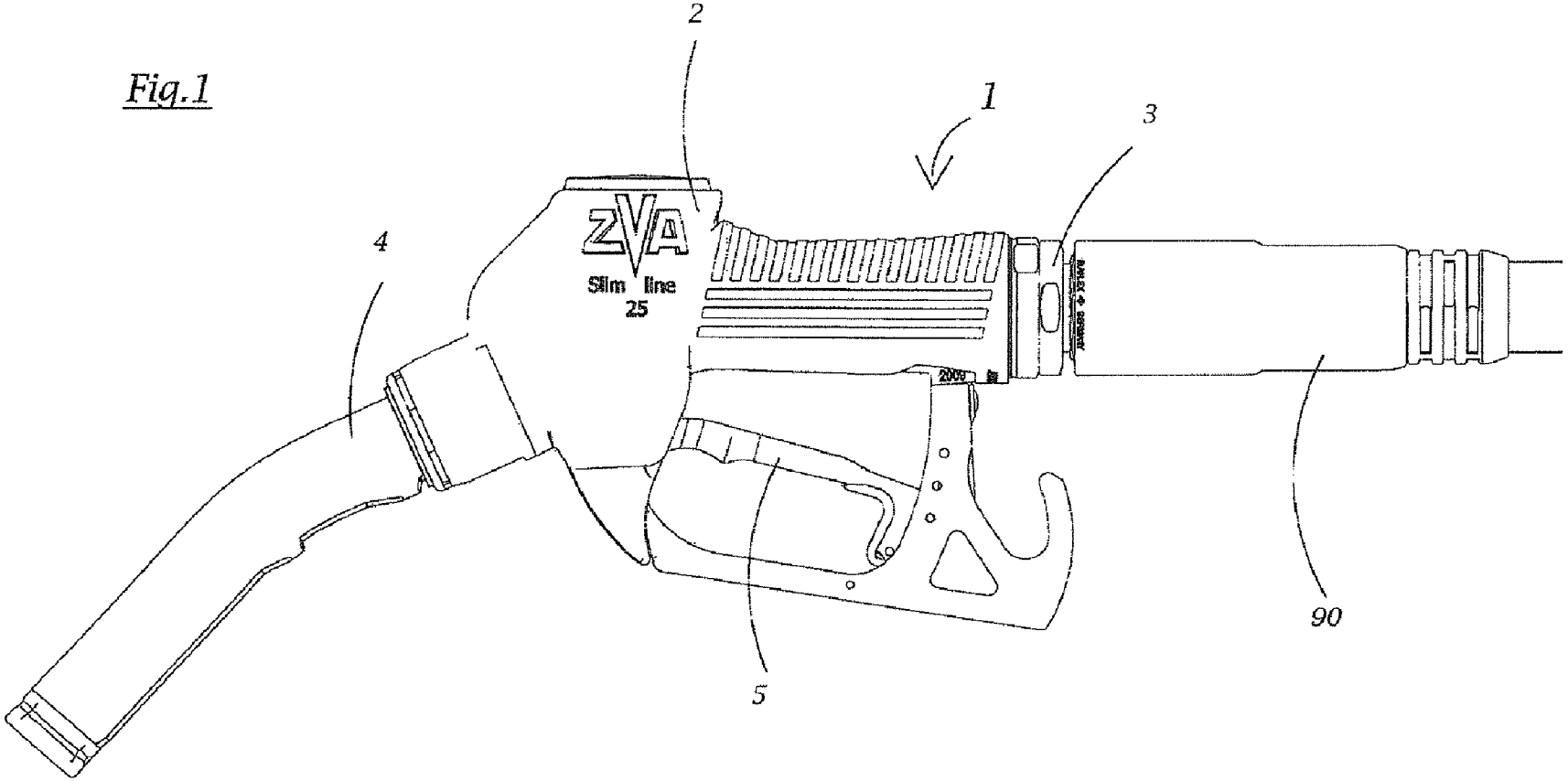
FIG. 1 shows a side view of a fuel pump nozzle according to the invention.

The fuel pump nozzle 1 (also called fuel nozzle colloquially) according to the invention, which is illustrated in the figures, is of modular construction, and therefore various embodiments of the individual components can be combined with one another as per a modular principle of construction. The fuel pump nozzle has a valve housing 2, a with inlet 3 for fuel, a discharge pipe 4 and a switching lever 5. The fuel pump nozzle 1 is connected via a connecting hose 90 to a filling pump comprising a fuel feed pump (not illustrated).

A valve insert cartridge forming the main valve 10 of the fuel pump nozzle 1 is arranged in the interior of the valve housing 1. With the main valve 10, the stream of liquid between the inlet 3 and outlet pipe 4 can be controlled. Inlet 3 and outlet pipe 4 together with the main valve 10 form a liquid line 6.

The main valve 10 has a conical valve seat 11 and a shut-off body 12 which is designed as a valve cone. The liquid line 6 leading through the valve seat 11 can be closed by the shut-off body 12.

The shut-off body 12 is divided into two substantially rotationally symmetrical partial bodies 12*a* and 12*b* which are displaceable axially counter to each other and are pressed apart by a spring 13 such that an axial gap can form in-between. The larger partial body 12*a*, which is arranged upstream of the main valve 10 in the direction of flow from the inlet 3 to the outlet pipe 4, can close the valve seat 11 in a pressure-proof manner. The advantages arising from a divided shut-off body 12 are described in European patent application 10005085.5.

A coaxial valve stem 14 which is connected fixedly to the shut-off body 12 is provided on the larger partial body 12*a* of the shut-off body 12. That end of the valve stem 14 which is remote from the shut-off body 12 is designed as a piston 15 which is guided in a housing 16 which is positionally fixed in relation to the valve seat 12. The housing 16 is arranged in the liquid line 6.

The piston 15 and the housing 16 form a cavity which serves as displacement space 20. The displacement space 20 is fluidically connected via a secondary line 22', which is called a throttle duct 21 and leads through the valve stem 14 and the shut-off body 12, to the liquid line 6 downstream of the shut-off body 12 and of the outlet pipe 4. The throttle duct 21 is designed for a fuel flow of 0.1 to 0.2 liter per minute. The displacement space 20 is furthermore fluidically connected to the region upstream of the shut-off body 12 and the inlet 3 by the gap 17 between the piston 15 and housing 16.

The piston 15 is provided with a seal 18 with which the secondary line 22, which is formed by the gap 17, is closed at least in the closed position of the shut-off body 12. This prevents fuel from being able to pass, when the main valve 10 is closed, from the inlet 3 via the secondary line 22, the displacement space 20 and the throttle duct 21 to the outlet pipe 4.

A magnetic pull element 30 is provided as the full hose lock which is arranged on one side at the upstream axial end of the piston 15 and on the other side on the housing 16. Said full hose lock endeavors to pull the main valve 10 into the closed position, in which the partial body 12*a* of the shut-off body 12 comes to bear in a sealing manner against the valve cone seat 11. In order to assist the closing effect of the magnetic pull element 30, a compression spring 31 is furthermore provided, the compression spring likewise pushing the partial body 12*a* of the shut-off body 12 in the direction of the closed position.

The magnetic pull element 30 and the compression spring 31 lock the shut-off body 12 in the closed position in such a manner that, in the full hose mode, the main valve 10 remains closed, and the fuel pump nozzle is thus prevented from running dry, as required, inter alia, in EN 13012. Full hose mode means that the fuel feed pump of the filling pump is no longer conveying but the connecting hose 90 between the filling pump and fuel pump nozzle 1 is full of fuel.

The magnetic pull element 30 and designed in such a manner that the force exerted by it on the shut-off body 12 in the direction of the closed position is only present to a very small extent, if at all, in the open position of the shut-off body 12. The compression spring 31 continues to act on the shut-off body 12 in the open position thereof. In comparison to a main valve 10, in which the lock for the full hose mode is provided exclusively by a full hose spring, the force acting in the direction of the closed position is nevertheless significantly reduced in the open position of the shut-off body 12, and therefore the drop in pressure via the main valve 10 can also be reduced.

The shut-off body 12 of the main valve 10 can additionally be pushed into the closed position by a closing spring 40 arranged downstream of the shut-off body 12. The closing spring 40 comprises an outer piston 41 which is of hollow design and can push against the shut-off body 12, namely the second partial body 12*b*, with a closing force in the direction of the closed position. The closing force is of a magnitude such that the two partial bodies 12*a* and 12*b* of the shut-off body 12 are compressed counter to the action of the spring 13 and the main valve 10 is completely sealed under any operating pressure present in the inlet, in particular even if the fuel feed pump is still conveying in the filling pump.

The closing force of the closing spring 40 is significantly greater than the force exerted by the magnetic pull element 30 in the compression spring 31 on the main valve in the closing direction. The closing spring 40 and the outer piston 41, which is used for transmitting force, push the shut-off body 12 into the associated valve seat 11.

An inner piston 42 is arranged in an axially displaceable manner in the outer piston 41. The inner piston 42 is prestressed in the direction of the closed position by a restoring spring 43. The inner piston 42 can be moved away from the shut-off body 12 in the axial direction by actuation of the switching lever 5. When the user pulls the switching lever 5, the switching lever pin 44 which is connected to the switching lever 5 and engages in a bore or groove 45, running in the radial direction, of the inner piston 42, pushes said inner piston 42 in the direction mentioned.

Figure 2:
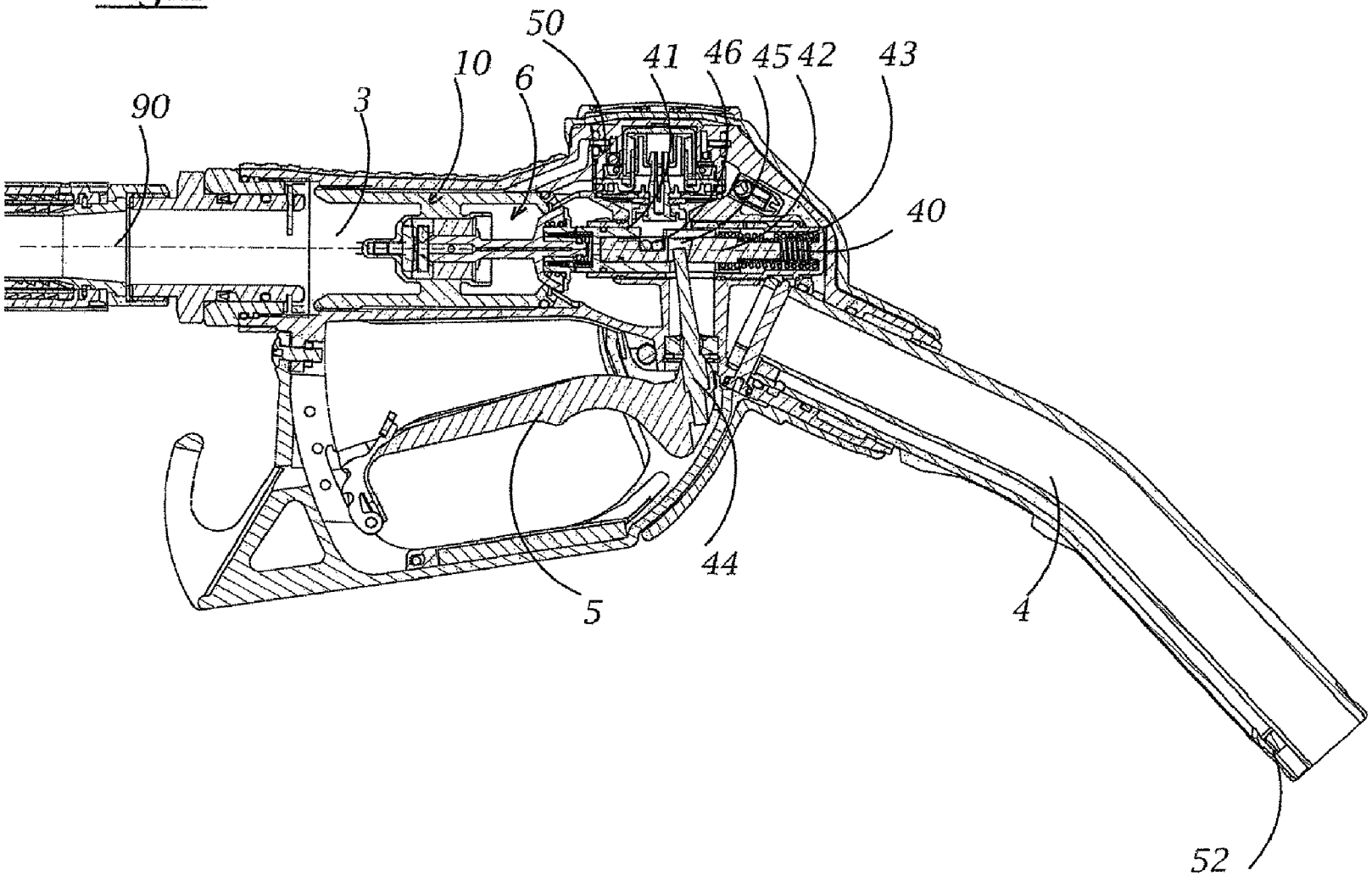
FIG. 2 shows a longitudinal section through the fuel pump nozzle from FIG. 1 with the main valve closed.
Figure 3:
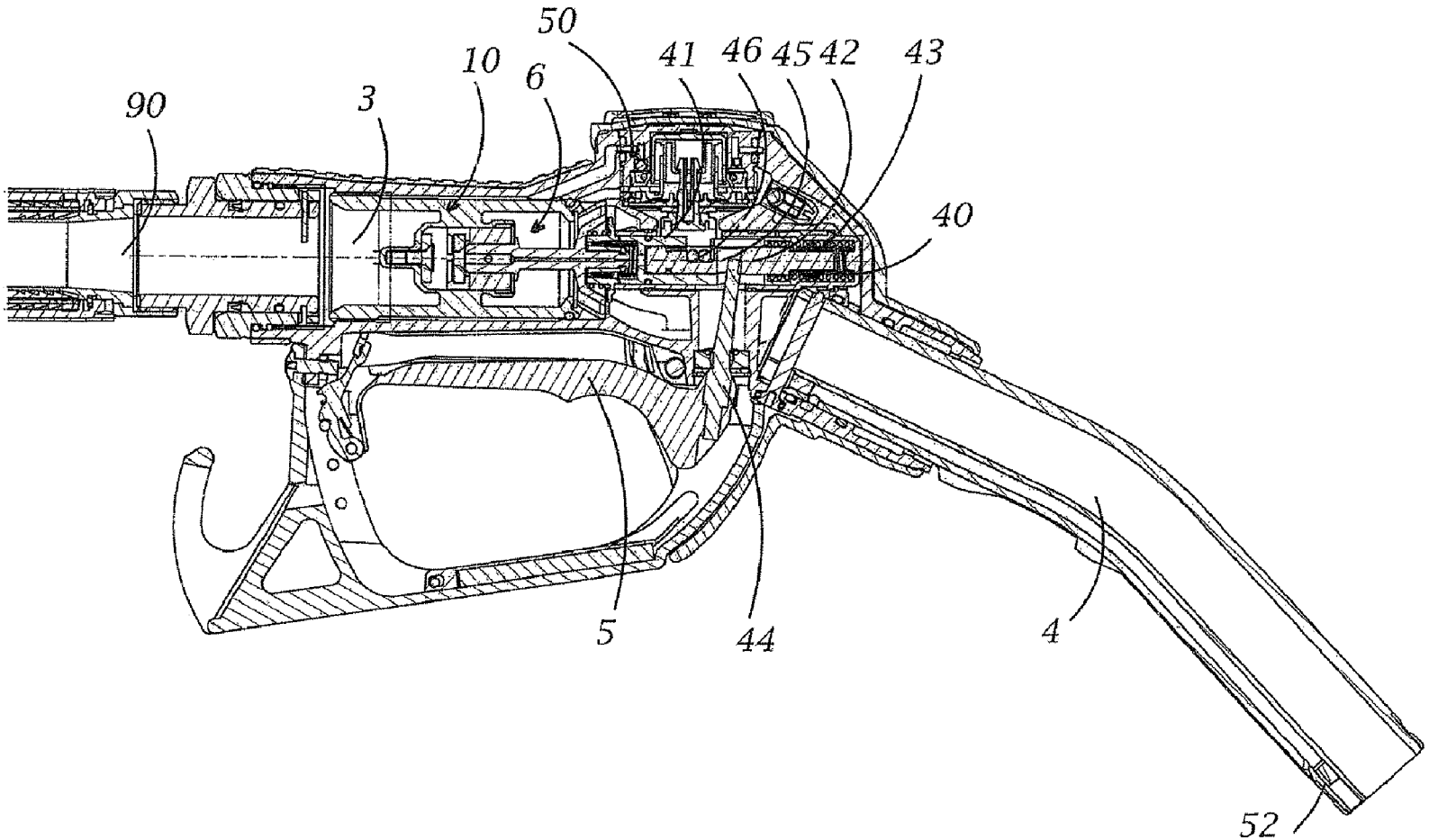
FIG. 3 shows a longitudinal section through the fuel pump nozzle from FIG. 1 with the main valve open.

As already mentioned, the inner piston 42 is arranged in an axially displaceable manner in the outer piston 41, but inner piston 41 and outer piston 42 may be connected kinematically to each other by means of a locking device such that, when the inner piston 42 moves, the outer piston 41 also moves. This connection or locking of outer piston 41 and inner piston 42 by locking elements referred to as locking rollers 46 is known in the prior art and, for example, described in U.S. Pat. No. 4,331,187 or DE 10 2008 010 988 B3. In the position illustrated in FIGS. 2 and 3, the locking rollers 46 are arranged in recesses aligned with each other of the outer piston 41 and inner piston 42 such that outer piston 41 and inner piston 42 are locked to each other and are displaced together by actuation of the switching lever 5.

If the actuation lever 5 is actuated only slightly and accordingly there is only a small axial displacement of the two pistons 41, 42, first of all the second partial body 12*b* of the shut-off body 12 is relieved of load and the spring 13 can drive the first partial body 12*a* and the second partial body 12*b* apart in the axial direction, thus forming a gap therebetween. The tightness of the main valve 10 is now reduced and, when pumping pressure is present at the inlet 3, the flow of small quantities of fuel to the discharge pipe 4 is possible.

If the switching lever 5 is pulled further, the outer piston 41 moves further away from the main valve 10, and therefore the shut-off body 12 is pulled into the closed position only by the magnetic pull element 30 and the compression spring 31. When the main valve 10 is closed and therefore, when the secondary line 22 is closed, ambient pressure prevails in the displacement space 20 owing to the connection via the throttle duct 21. Owing to the liquid pressure of the inlet 3, which liquid pressure is present at that end of the piston 15 which faces the liquid line 6, a pressure difference occurs, pulling the shut-off body 12 into the closed position. This pressure difference via the piston 15 is smaller than the oppositely acting pressure difference via the shut-off body 12. The pumping pressure present at the inlet 2 during a regular refueling operation is significantly greater than the sealing pressure under the action of the magnetic pull element 30, the compression spring 31 and the pressure difference via the piston 15, and therefore liquid or fuel can now flow through the main valve 10 at a high flow rate.

The refueling operation can be ended by the switching lever 5 being let go of by the user, or a possible latching of the switching lever 5 being released. The closing spring 40 and restoring spring 43 then push the inner piston 42 and outer piston 41, and therefore also the shut-off body 12, back into the closed position and close the main valve 10.

However, a refueling operation is frequently not ended manually in this manner but rather by the triggering of one of two automatic safety shut-offs, which are denoted together by the reference number 50, either when the tank is full or upon reaching a preselected quantity of fuel after the pump is shut off.

Both the first and the second automatic safety shut-off 50 are based on the principle of drawing the locking rollers 46 out of the grooves or recesses of the inner piston 42 and outer piston 41 and of thereby releasing the locking of said pistons. The outer piston 41 can then snap back into the closed position under the action of the closing spring 40 and can act again on the shut-off body 12 of the main valve 10 with the large closing force described.

After such a triggering of one of the safety shut-offs 50, the inner piston 42 is initially still in the displaced position because of the switching lever 5 being pulled as before. The recesses for the locking rollers 46 in the inner piston 42, on the one hand, and outer piston 41, on the other hand, are no longer aligned with one another. Only when the switching lever 5 is released and the restoring spring 43 can move the inner piston 42 back into the starting position thereof are the recesses aligned with one another again and the locking rollers 46 can optionally again lock the inner and outer pistons 41, 42 to each other. It is thereby ensured that, after triggering of one of the automatic safety shut-offs 50, a new refueling operation can begin only when the switching lever 5 has first of all been released and moved back into the inoperative position thereof.

The first safety shut-off closes the main valve 10 by pulling out the locking rollers 46 as soon as it is established via a sensor 52 or the like that the tank which is to be filled is full. The details of said operative mechanism which is known from the prior art are described, for example, in DE 10 2008 010 988 B3 and do not require any further explanation here. The second safety shut-off 50, which is likewise known from the prior art, causes the main valve 10 to be automatically closed if the pressure in the inlet 3 falls below a minimum pressure. For example, the pressure falls below the minimum pressure when the fuel feed pump is switched off.

As soon as the main valve 10 is intended to be closed by one of the two safety shut-offs 50, the locking rollers 46 are drawn out of the inner piston 42 and the outer piston 41 is pressed by the action of the closing spring 40 onto the shut-off body 12 in order to move the latter into the closed position. Since, as discussed, the spring force of the closing spring 40 is high in order to reach the required tightness in the closed position, the acceleration of the outer piston 41 and of the shut-off body 12 is also high. In the prior art, the shut-off body 12 strikes against the valve seat 11 without being braked, as a result of which pressure surges occur in the fuel pump nozzle and—via the liquid in the connecting hose 90—also in the filling pump, in particular in the fuel pump.

In the case of the illustrated fuel pump nozzle 1 according to the invention, the displacement space 20 is filled with fuel in the open position of the main valve 10. The fuel can pass via the secondary line 22, which is formed by the gap 18 between the piston 15 and housing 16, and/or via the throttle duct 21 from the liquid line 6 into the displacement space 20. If the main valve 10 is now intended to be closed by the closing spring 40 (or in another manner), the liquid in the displacement space 20 has to be displaced out of the latter in order to reduce the size thereof. Since only the secondary line 22 and the throttle duct 21 are available for this, significant flow resistances arise which act counter to the movement of the shut-off body 12 in a damping manner and brake the latter.

Figure 4A:
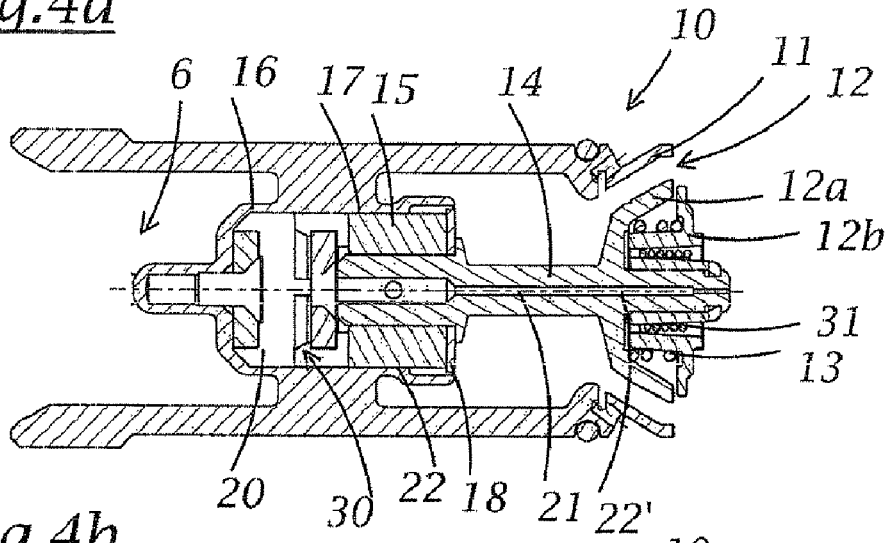
FIGS. 4*a, b, c* show detailed illustrations of the main valve from FIGS. 2 and 3 in various positions.
Figure 4B:
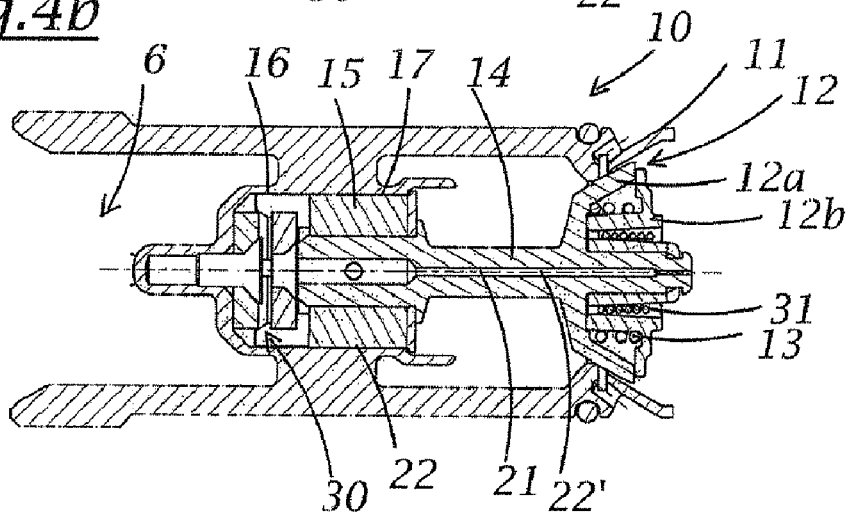
Figure 4C:
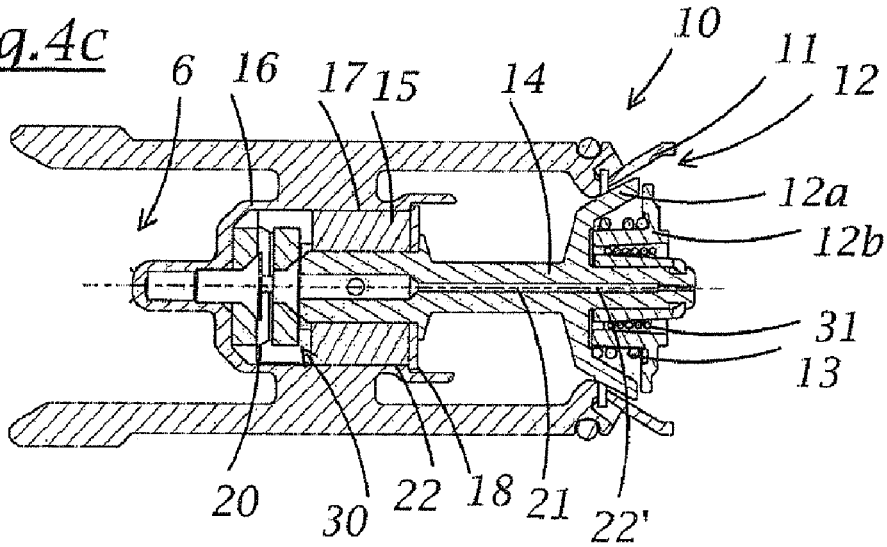

In the exemplary embodiment illustrated, the stroke of the piston 15 and therefore also of the shut-off body 12 between the open position (cf. FIG. 4*b*) and closed position (cf. FIG. 4*a*) is 5 mm. Starting from the open position, an intermediate position, which is illustrated in FIG. 4*c*, is provided after 4 mm along said stroke.

If the main valve 10 is closed via the closing spring 40, the shut-off body 12 and therefore also the piston are first of all displaced from the open position to the intermediate position. In this region, the liquid can flow out of the displacement space 20 through the secondary line 22 and the throttle duct 21, it being possible for the flow to be equally distributed between the secondary line 22 and throttle duct 21. A damping effect occurs which is limited if the acceleration or the speed to which the shut-off body moves into the closed position.

As soon as the intermediate position is reached, the seal 18 closes the secondary line 21, and therefore the fuel can then flow out of the displacement space 20 only through the throttle duct 20. The flow resistance for a position of the piston 15 or of the shut-off body 12 between the intermediate position and closed position is increased in relation to a position between the open position and intermediate position, and therefore the damping effect is also increased. The shut-off body 12 is therefore braked further, specifically in such a manner that it only causes a very small pressure surge, if any at all, when it strikes against the valve seat 11. Nevertheless, the pressure tightness of the main valve 10 is not restricted.

In contrast to the hard-sealing fit of the shut-off body 12 in the valve seat 11 (i.e. the sealing effect is achieved exclusively in the closed position), the seal 18 for closing the gap 17 and therefore the secondary line 22 are soft-sealing. Said seal not only seals the gap 17 in a certain position of the piston 15 or of the shut-off body 12 but in all positions within a region, namely in the region between the intermediate position and closed position.

In addition to the position of the intermediate position and the maximum flow through the throttle duct 21, it is also possible to coordinate, for example, the dimension of the displacement space, maximum flow through the secondary line 22 and the spring force of the closing spring 40 with one another in such a manner that the main valve 10 is closed by one of the two safety shut-offs 50, 51 in less than 1 s, preferably in a closing time of 0.2-0.5 s.

In the closed state, the pressure prevailing in the inlet 3 acts on that surface of the shut-off body 12 with which the valve seat 11 is closed. Since ambient pressure prevails in the outlet pipe 4 in the closed state, the pressure prevailing in the inlet 3 or the resulting pressure difference therefore acts in an opening manner on the main valve 10. Since, however, ambient pressure likewise prevails in the displacement space 20 because of the throttle duct 21, the pumping pressure prevailing on that side of the piston 15 which faces the shut-off body 12, or the resulting pressure difference, acts in a closing manner on the piston 15 or the shut-off body 12. Even if the pressure difference via the piston 15 is smaller than via the shut-off body 12, the force acting in an opening manner on the shut-off body 12 because of pressure in the inlet 3 is reduced. The full hose lock and/or the closing spring 40 can be matched to said reduced pressure. It is thus possible that the closing spring 40 has only to reach the basic tightness, which is required in the standard EN 13012, of 3.5 bar, since every additional security is ensured by the pressure difference via the piston 15. A weaker closing spring, as becomes possible because of the described pressure difference via the piston 15, increases the user friendliness of the fuel pump nozzle 1. In particular, less force is required for operating the switching lever 5. In addition, the forces to be transmitted between the inner and outer pistons 42, 41 via the locking rollers 46 are reduced, which permits locking rollers 46 which are of smaller dimensions and/or are less durable—and therefore more advantageous. Owing to the weaker closing spring 40, the outer piston can advantageously also be manufactured from plastic.

The invention claimed is:

1. A main valve (10) for a fuel pump nozzle (1), said main valve (10) comprising:

a) a shut-off body (12) for closing a liquid line (6); and b) a displacement space (20) having a volume that is reduced by movement of the shut-off body (12) from an open position to a closed position, wherein:

1) the displacement space (20) is fluidically connected upstream and downstream of the shut-off body (12) to the liquid line (6) via a first secondary line (22) and a second secondary line (22'); and 2) the first secondary line (22) to the liquid line (6) upstream of the shut-off body (12) is closed in the closed position of the shut-off body (12).

2. The main valve as claimed in claim 1, wherein an intermediate position is provided between the open position and the closed position of the shut-off body (12), and the first secondary line (22) to the liquid line (6) upstream of the shut-off body (12) is closed when the shut-off body (12) is in a position between the intermediate position and the closed position.

3. The main valve as claimed in claim 2, wherein the open position and the intermediate position delimit a first region and the intermediate position and the closed position delimit a second region, and wherein the first region is at least twice as large as the second region.

4. The main valve as claimed in claim 2, wherein the open position and the intermediate position delimit a first region and the intermediate position and the closed position delimit a second region, and wherein the first region is at least four times as large as the second region.

5. The main valve as claimed in claim 1, wherein the displacement space (20) is a cavity that is formed by a housing (16) and a piston (15) guided within the housing (16).

6. The main valve as claimed in claim 5 wherein the piston (15) is connected to the shut-off body (12) by a valve stem (14).

7. The main valve as claimed in claim 5, wherein the displacement space (20) is fluidically connected to the liquid line (6) upstream of the shut-off body (12) by a gap (17) between the piston (15) and the housing (16).

8. The main valve as claimed in claim 6, wherein the displacement space (20) is fluidically connected to the liquid line (6) downstream of the shut-off body (12) by a throttle duct (21).

9. The main valve as claimed in claim 8, wherein the throttle duct (21) is formed in the valve stem (14) and/or the shut-off body (12).

10. The main valve as claimed in claim 8, wherein the throttle duct (21) is designed for a maximum flow of from approximately 0.1 to 0.2 liter of fuel per minute.

11. The main valve as claimed in claim 5, wherein a liquid pressure is present upstream of the shut-off body (12) at an end of the piston (15) that faces away from the displacement space (20).

12. The main valve as claimed in claim 1, wherein the shut-off body (12) is a valve cone.

13. The main valve as claimed in claim 1 further comprising a full hose lock, wherein the full hose lock is a magnetic pull element (30).

14. The main valve as claimed in claim 13, wherein the magnetic pull element (30) is arranged in the displacement space (20).

15. A fuel pump nozzle (1) comprising:

a) an inlet (3);

b) a discharge pipe (4);

c) a main valve (10) for controlling a stream of liquid between the inlet (3) and the discharge pipe (4); with d) a shut-off body (12); and e) a displacement space (20), wherein:

1) the displacement space (20) has a volume that is reduced in size by movement of the shut-off body (12) from an open position to a closed position;

2) the displacement space (20) is fluidically connected to the inlet (3) and the discharge pipe (4) via a first secondary line (22) and a second secondary line (22'); and 3) the first secondary line (22) to the inlet (3) is closed when the shut-off body (12) is in the closed position.

16. The fuel pump nozzle as claimed in claim 15, wherein the fuel pump nozzle (1) comprises a first automatic safety shut-off (50) that closes the main valve (10) when a liquid level in a tank to be filled reaches a filling level sensor (52) arranged in a region of the discharge pipe (4) and/or a second safety shut-off (51) that closes the main valve (10) when a liquid pressure in the inlet (3) is below a minimum value.

17. The fuel pump nozzle as claimed in claim 15, wherein the shut-off body (12) closes a liquid line (6) and the displacement space (20) has a volume that is reduced by movement of the shut-off body (12) from an open position to a closed position, wherein:

1) the displacement space (20) is fluidically connected upstream and downstream of the shut-off body (12) to the liquid line (6) via a first secondary line (22) and a second secondary line (22');

2) the first secondary line (22) to the liquid line (6) upstream of the shut-off body (12) is closed in the closed position of the shut-off body (12); and 3) an intermediate position is provided between the open position and the closed position of the shut-off body (12) and the first secondary line (22) to the liquid line upstream of the shut-off body (12) is closed when the shut-off body (12) is in a position between the intermediate position and the closed position.

18. The fuel pump nozzle (1) as claimed in claim 15, wherein the main valve (10) is closed by an automatic safety shut-off (50, 51) in a time that is less than 1 s.

19. The fuel pump nozzle (1) as claimed in claim 18, wherein the main valve (10) is closed by the automatic safety shut-off (50, 51) in a time that is from 0.2 to 0.5 s.

* * * * *

UNITED STATES PATENT AND TRADEMARK OFFICE

CERTIFICATE OF CORRECTION

PATENT NO. : 8,347,924 B2
APPLICATION NO. : 13/231557
DATED : January 8, 2013
INVENTOR(S) : Heinz-Ulrich Meyer It is certified that error appears in the above-identified patent and that said Letters Patent is hereby corrected as shown below:

Title Page, Item (73) Assignee should read as follows:

-- Elaflex Hiby Tanktechnik GmbH & Co. KG, Hamburg (DE) --

Signed and Sealed this
Eighteenth Day of June, 2013

Teresa Stanek Rea
*Acting Director of the United States Patent and Trademark Office*